US010729268B2

(12) United States Patent
Beyda et al.

(10) Patent No.: US 10,729,268 B2
(45) Date of Patent: Aug. 4, 2020

(54) HANGER RING WITH INTEGRAL HOOK

(71) Applicant: TOWN & COUNTRY LINEN CORP., New York, NY (US)

(72) Inventors: Jeffrey Beyda, New York, NY (US); Robert Passaretti, New York, NY (US); Gina Barnaba, New York, NY (US)

(73) Assignee: TOWN & COUNTRY LINEN CORP., New York, NY (US)

( * ) Notice: Subject to any disclaimer, the term of this patent is extended or adjusted under 35 U.S.C. 154(b) by 248 days.

(21) Appl. No.: 15/654,259

(22) Filed: Jul. 19, 2017

(65) Prior Publication Data

US 2018/0020861 A1 Jan. 25, 2018

Related U.S. Application Data

(60) Provisional application No. 62/364,208, filed on Jul. 19, 2016.

(51) Int. Cl.
*A47H 13/02* (2006.01)
*A47H 23/00* (2006.01)
*A47H 13/04* (2006.01)

(52) U.S. Cl.
CPC ..... *A47H 13/02* (2013.01); *A47H 13/04* (2013.01); *A47H 23/00* (2013.01)

(58) Field of Classification Search
CPC ..... A47H 13/01; A47H 13/02; A47H 13/04; A47H 23/00; Y10S 160/06; A47K 23/38
USPC ..... 4/610; 160/348
See application file for complete search history.

(56) References Cited

U.S. PATENT DOCUMENTS 635,295 A * 10/1899 Brown ..... A47H 13/04 16/87.2
5,186,232 A * 2/1993 Zahner ..... A47H 13/00 160/330
5,647,107 A * 7/1997 Brewster ..... G09F 7/00 24/713.6
5,769,144 A * 6/1998 Carter ..... A44B 13/0076 160/123
6,006,406 A * 12/1999 Chung ..... A41H 37/02 24/114.12
6,189,597 B1 2/2001 Cheng
6,494,248 B1 12/2002 Zahner
6,757,945 B2 * 7/2004 Shibuya ..... A47G 27/0418 16/8
6,935,402 B2 8/2005 Zahner
7,058,988 B1 * 6/2006 Zahner ..... A41D 27/22 2/271
D551,950 S * 10/2007 Davenport ..... D8/367
7,296,609 B2 11/2007 Zahner
(Continued)

*Primary Examiner* — Brent W Herring
(74) *Attorney, Agent, or Firm* — Leason Ellis LLP

(57) ABSTRACT

A product include an item for hanging. The item has a top edge and a plurality of spaced holes formed therein proximate the top edge. The plurality of spaced holes are arranged in pairs, wherein between each pair of holes, therein is a slit formed through the item. The slit is defined by a linear center portion and first and second angled end portions at respective ends of the linear center portion. A hanger ring assembly is also provided and includes grommet backings that mate to grommet bases so as to capture the item therebetween and are arranged about the holes at the first and second angled end portions of the slit.

19 Claims, 14 Drawing Sheets

(56) References Cited

U.S. PATENT DOCUMENTS

| | | | | |
|---|---|---|---|---|
| 7,909,082 | B2 * | 3/2011 | Peoples | A47H 2/00 160/123 |
| 8,381,374 | B2 | 2/2013 | Henry et al. | |
| 8,408,275 | B2 | 4/2013 | DeWees et al. | |
| 8,672,002 | B2 | 3/2014 | Stein | |
| 9,107,544 | B2 | 8/2015 | Cittadino et al. | |
| 9,131,758 | B2 | 9/2015 | Stein | |
| D741,085 | S | 10/2015 | Ruble | |
| D746,078 | S | 12/2015 | Zahner | |
| 9,572,447 | B2 | 2/2017 | Pierce | |
| 9,895,031 | B2 * | 2/2018 | Hsu | A47K 3/38 |
| 2007/0050904 | A1 * | 3/2007 | Harwanko | A47K 3/38 4/558 |
| 2007/0284058 | A1 * | 12/2007 | Peoples | A47H 2/00 160/123 |
| 2009/0071613 | A1 * | 3/2009 | Galbiati | A47K 3/38 160/330 |
| 2011/0010891 | A1 * | 1/2011 | Rowley | A47H 5/03 16/2.1 |
| 2013/0145543 | A1 * | 6/2013 | Cittadino | A47H 13/02 4/610 |
| 2014/0251551 | A1 * | 9/2014 | Chung | A47H 3/02 160/38 |
| 2017/0049275 | A1 * | 2/2017 | Hsu | A47K 3/38 |

* cited by examiner

HANGER RING WITH INTEGRAL HOOK

CROSS REFERENCE TO RELATED APPLICATION

The present application claims priority to and the benefit of U.S. patent application Ser. No. 62/364,208, filed Jul. 19, 2016, which is hereby incorporated by reference in its entirety.

TECHNICAL FIELD

The present invention relates to accessories for hanging a first hanging material, such as a curtain or liner, to a supporting rod, and more particularly, relates to a hanger ring with integral hook for hanging a second hanging material, such as a liner, relative to the first hanging material without requiring removal of the rod or adding additional hardware, such as hooks or the like, to either of the hanging materials.

BACKGROUND

As is well known, drapery is often used in a house or commercial space for both functional and decorative purposes. Types of drapery include window curtains and door curtains. The drapery is hung from a pole that is anchored to a wall using hardware. In addition, in the bathroom, it is commonplace for a tub that has a shower to have a shower curtain that is suspended from a pole. The shower curtain serves not only a decorative purpose but also functions to contain water within the tub when a person takes a shower. The shower curtain can be formed of a waterproof material, such as a suitable plastic material. Also, liners are often used to protect the shower curtain since many shower curtains are formed of fabrics that are not waterproof and thus, the installed liner serves to cover and protect the fabric shower curtain. In particular, many people like the high end look of a fabric shower curtain (which can be formed in many different fabrics) and therefore, a plastic (waterproof) liner is needed to protect the fabric shower curtain.

In one system of the prior art, separate devices, such as hooks or clips, are utilized to connect portions of the curtain (e.g., shower curtain) to the rod. In an alternative system of the prior art, the curtain or drape is mounted by threading a rod through the reinforced holes in that curtain.

U.S. Pat. Nos. 6,189,597; 6,494,248; and 6,935,402 disclose an alternative product to traditional hooks and clips and while, this product is useful, there are a number of shortcomings. First, the product is in the form of hanger rings that are associated with the curtain itself and thus, while the hanger rings are suitable for hanging the curtain itself, the hanger rings do not permit a second hanging material, such as a liner, to be hung. As mentioned above, when the shower curtain is formed of a fabric, a liner should be used in combination to protect the fabric and provide a waterproof barrier to keep the water in the tub. Second, the linear slits formed in the curtain are visible to the user since they are located above the user (pole height). The visibility of the linear slits can be viewed as being unsightly. There is therefore, a desire to provide an accessory that overcomes the above deficiencies.

SUMMARY

In accordance with one embodiment of the present invention, a hanger ring assembly is provided and is configured for attachment to an article to be hung. The hanger ring assembly includes a plurality of grommet backings including a set of first grommet backings and a set of second grommet backings. Each first grommet backing is in the form of a split ring defined by a circular body with a first slot formed therein. The circular body has a plurality of spaced holes formed therein. Each second grommet backing is in the form of a split ring defined by a circular body with a second slot formed therein. The circular body has a plurality of spaced holes formed therein. Each of the first grommet backing and the second grommet backing includes a clip extending outwardly therefrom. A sagittal axis that passes longitudinally through the clip divides each of the first grommet backing and the second grommet backing into a first half and a second half with an outer face of each of the first grommet backing and the second grommet backing facing outward. The first slot is located in the first half, while the second slot is located in the second half and the first slot is formed at an angle other than 90 degrees relative to the sagittal axis and the second slot is formed at an angle other than 90 degrees relative to the sagittal axis.

The hanger ring assembly also includes a plurality of grommet bases that are configured to mate with both the first set of grommet backings and the second set of grommet backings, with the article disposed and captured therebetween. Each grommet base is a split ring defined by a circular body with a slot formed therein. The circular body has a plurality of spaced protrusions that are configured for reception with the plurality of spaced holes of the respective first grommet backing and the second grommet backing.

In another embodiment, a product is provided and includes an item for hanging. The item has a top edge and a plurality of spaced holes formed therein proximate the top edge. The plurality of spaced holes are arranged in pairs. Between each pair of holes, therein is a slit formed through the item. The slit is defined by a linear center portion and first and second angled end portions at respective ends of the linear center portion.

The product also includes a hanger ring assembly that includes a plurality of grommet backings including a set of first grommet backings and a set of second grommet backings. Each first grommet backing is a split ring defined by a circular body with a first slot formed therein and each second grommet backing is a split ring defined by a circular body with a second slot formed therein. The hanger ring assembly also includes a set of first grommet bases that are configured to mate with the first set of grommet backings and a set of first grommet bases that are configured to mate with the second set of grommet backings. The item is disposed and captured therebetween, each of the first and second grommet bases being a split ring defined by a circular body with a slot formed therein. The circular body has a plurality of spaced protrusions that are configured for reception with the plurality of spaced holes of the respective first grommet backing and the second grommet backing.

Each of the first grommet backing, the second grommet backing, and the grommet base surrounds one respective hole formed in the item with the first slot of each first grommet backings and the slot of each first grommet base being aligned with the first angled end portion of the slit. The second slot of each second grommet backing and the slot of each second grommet base are aligned with the second angled end portion.

BRIEF DESCRIPTION OF THE DRAWING FIGURES

DETAILED DESCRIPTION OF CERTAIN EMBODIMENTS

The present invention is directed to an accessory product for detaching a material from a rod without removing the rod. The accessory product is intended for use with hanging or otherwise suspended materials, such as window treatments (window curtains, drapes, etc.), shower curtains, windscreens, towels, and so forth. Such suspended materials (referred to herein as "hanging materials" for brevity) are often mounted onto rods.

FIGS. 1-5 show a product accessory in the form of a hanger ring with integral hook ("hanger ring") 100 in an assembled (interlocked) position. The hanger ring 100 is formed of two separate parts, namely, a grommet backing 110 and a grommet base 200 that mate with one another to form a coupled assembly. The grommet backing 110 and grommet base 200 are thus positionable between a detached (unlocked) position and an attached/assembled (locked or interlocked) position.

Figure 7:
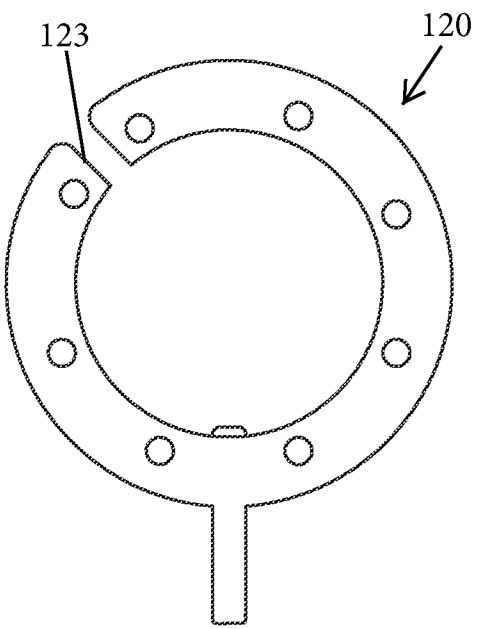
FIG. 7 is a front elevation view of a second (left) grommet backing.

Due to the construction of the present hanger rings 100, the grommet backing parts 110 are arranged into a first (right) grommet backing 130 (see, FIG. 6) and a second (left) grommet backing 120 (see, FIG. 7). As will be discussed below, the first and second grommet backings 130, 120 attach to respective grommet bases 200 to form a pair of assembled hanger rings that are positioned in pairs (e.g., one left and one right) next to one another along the hanging material.

FIGS. 6 and 9-11 illustrate the first grommet backing 130 in detail and FIGS. 7 and 12-14 illustrate the second grommet backing 120 in detail.

The first grommet backing 130 of FIGS. 6 and 9-11 is defined by a body 122 that has an annular shape with a center opening 121 defined thereby. The center opening 121 has a circular shape when the body 122 is annular in shape as shown. The body 122 is of a split ring design in that there is a slot (opening) 123 formed therein so as to define first and second spaced free ends 124, 125 of the body 122. As described herein, since the body 122 is formed of a flexible material, the free ends 124, 125 can flex relative to one another, thereby increasing the size of the gap/slot/space 123 to permit insertion of a support pole (rod) into the opening 121 and the pole also travels within the slot 123 when the pole is coupled to the rings.

Figure 10:
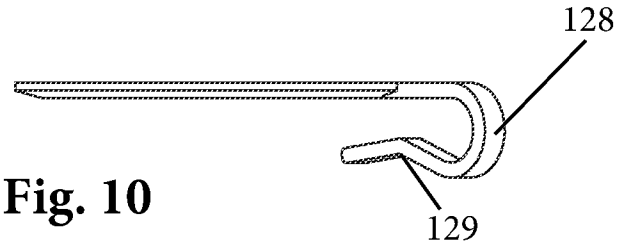
FIG. 10 is a side perspective view of the first (right) grommet backing.
Figure 11:
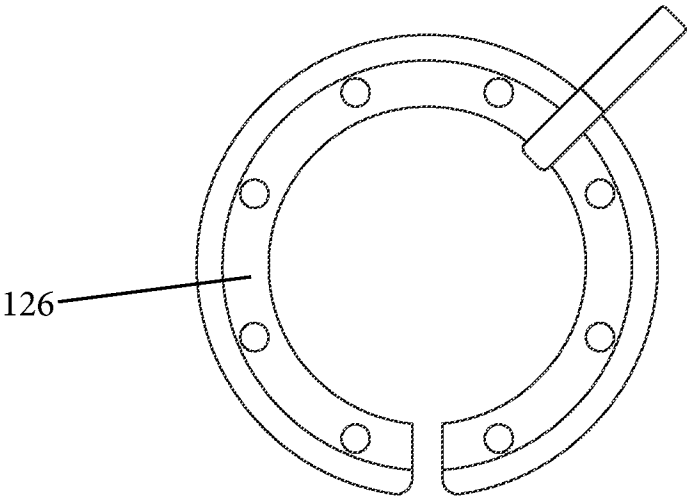
FIG. 11 is a rear elevation view of the first (right) grommet backing.
Figure 9:
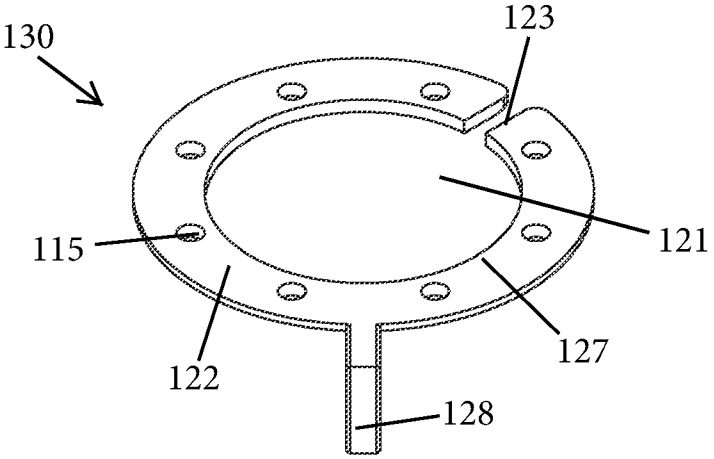
FIG. 9 is a front perspective view of the first (right) grommet backing.
Figure 13:
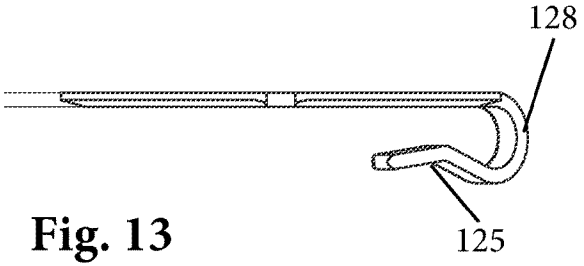
FIG. 13 is a side perspective view of the second (left) grommet backing.
Figure 12:
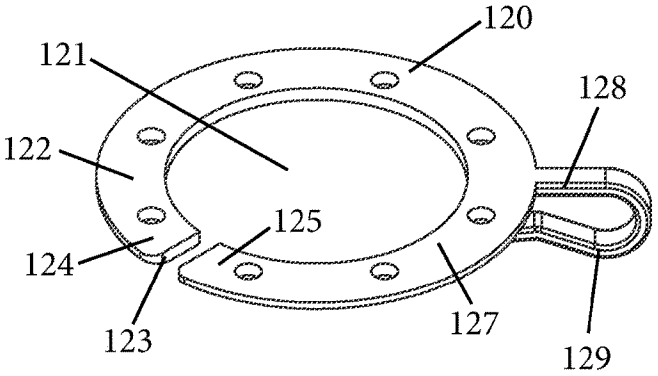
FIG. 12 is a front and side perspective view of the second (left) grommet backing.
Figure 14:
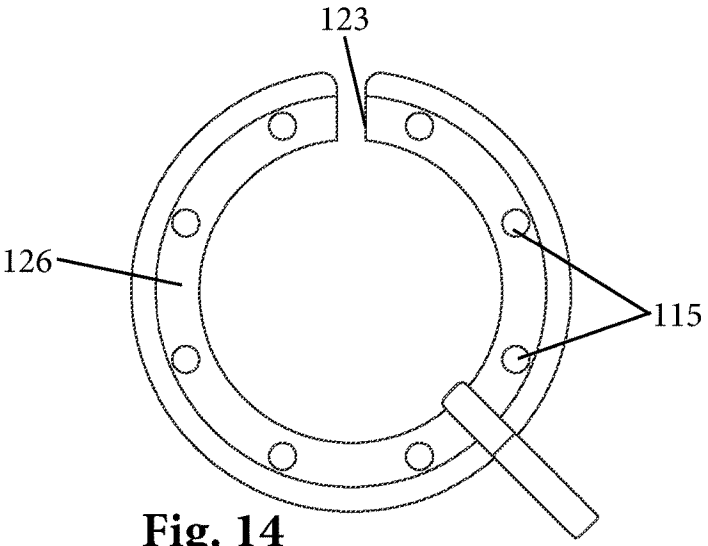
FIG. 14 is a rear elevation view of the second (left) grommet backing.
Figure 15:
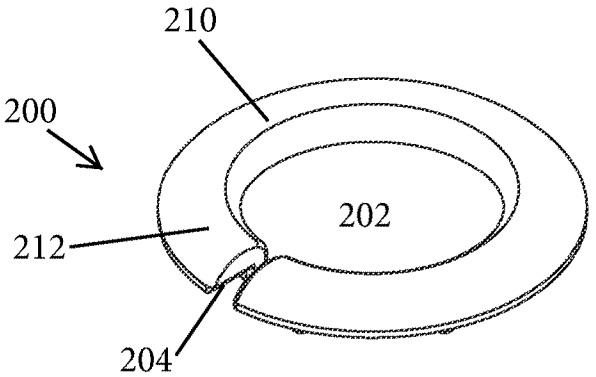
FIG. 15 is a front and side perspective view of the grommet base.
Figure 16:
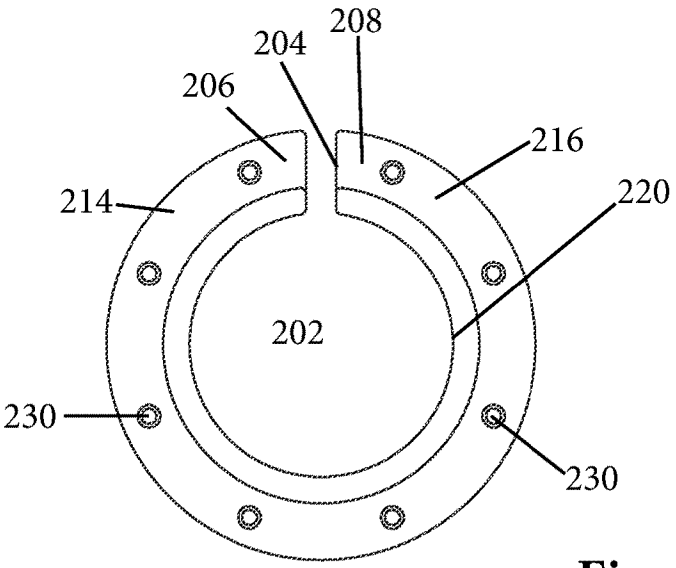
FIG. 16 is a rear elevation view of the grommet base.
Figure 17:
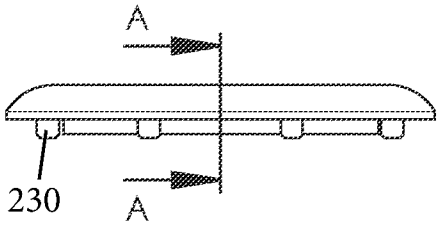
FIG. 17 is a side elevation view of the grommet base.
Figure 18:
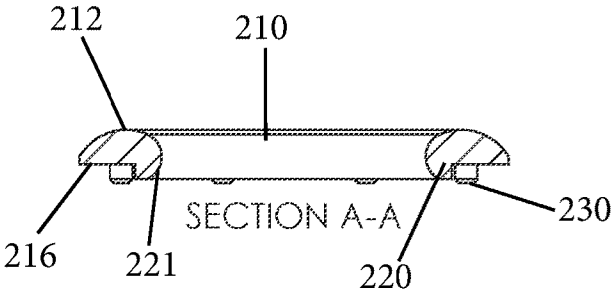
FIG. 18 is a cross-sectional view taken along the line A-A of FIG. 17.

The illustrated body 122 is a generally planar structure in that both a first face (outer face) 126 and opposing second face (inner face) 127 are smooth, flat surfaces that are parallel to one another. As shown in FIGS. 10 and 11, the outer peripheral edge of the first face 126 can be slightly angled or curved (rounded).

The body 122 includes a plurality of through holes (openings) 115 that are formed therein spaced apart in a circumferential manner. The number of openings 115 can vary and as described herein, the openings 115 receive complementary structures of the grommet base 200 to attach and couple the part 120 (and part 130) and 200 to one another.

Figure 6:
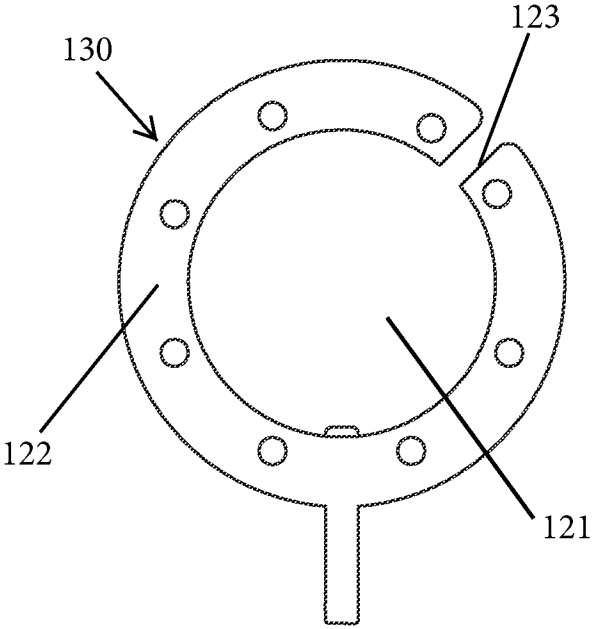
FIG. 6 is a front elevation view of a first (right) grommet backing.

The body 122 also includes an integral hook (clip) 128. The integral hook 128 is an extension of the body 122. The integral hook 128 can be formed to extend along the first face 126 and terminates at the inner edge of the body 122. The integral hook 128 comprises a curved structure that has a leg 129 that is folded back on top of itself such that a free end of the leg 129 extends to and terminates at or about the inner edge of the body 122 (as shown in FIG. 6, it can partially extend into opening 121). As shown, the leg 129 can be angled toward the fixed part of the hook 128 disposed along the first face 126. The integral hook 128 is also preferably formed of a material that can flex.

In one embodiment, the first grommet backing 130 is formed as a single piece (e.g., a molded piece) that is formed of a suitable material, such as a plastic. However, it will be understood that the first grommet backing 130 can be formed of other suitable material, such as a metal, etc.

As can be seen in FIG. 6, when the integral hook 128 is positioned in the 6 o'clock position with an outer face of the backing facing outward, the slot 123 is generally positioned between the 1 o'clock and 2 o'clock positions. As mentioned above, the first grommet backing 130 can be thought of as being the right grommet backing (since slot 123 is formed on the left side).

As shown in FIGS. 7 and 12-14, the second grommet backing 120 can be thought of as being the left grommet backing (since slot 123 is formed on the right side) and is very similar to the first grommet backing 130 and therefore, like numbers are used to indicate the same elements. The only difference between the first and second grommet backings 130, 120 is the location of the slot 123. More specifically, as can be seen in FIG. 7, when the integral hook 128 is positioned in the 6 o'clock position with an outer face of the backing facing outwardly, the slot 123 is generally positioned between the 10 o'clock and 11 o'clock positions.

The grommet backings 120, 130 are formed of flexible materials, such as suitable plastics.

The grommet base 200 is shown in FIGS. 8 and 15-18. The grommet base 200 is defined by a body 210 that has an annular shape with a center opening 202 defined thereby. The center opening 202 has a circular shape when the body 210 is annular in shape as shown. The body 210 is of a split ring design in that there is a slot (opening) 204 formed therein so as to define first and second spaced free ends 206, 208 of the body 210. As described herein, since the body 210 is formed of a flexible material, the free ends 206, 208 can flex relative to one another thereby increasing the size of the gap/slot/space 204 to permit insertion of a support pole (rod) within the slot 204.

The illustrated body 210 has a first face (outer face) 212 and an opposing second face (inner face) 214, with the second face 214 for mating with the second face 127. As shown in FIGS. 15-18, the second face 214 includes an outer peripheral surface 216 that is a smooth flat surface and extends to the outer edge of the illustrated body 210. The second face 214 also has an inner lip 220 that is formed along an inner circumferential edge. The inner lip 220 can, as illustrated, be in the form of an upstanding wall or shoulder that has at least a portion that is formed at a right angle relative to the flat portion (outer peripheral surface 216). In particular, the outer edge of the inner lip 220 can be formed at a right angle, while an inner edge of the inner lip 220 is curved as indicated at 221. The curvature 221 of the inner edge defines the center opening 202. The function of this curvature 221 is described below. This curvature 221 extends from the first face 212 to the second face 214.

The body 210 also includes a number of posts 230 in the form of upstanding protrusions that are integral to the body 210. The posts 230 can be in the form of cylindrical shaped posts that are circumferentially spaced about the body 210. It will be understood that the number of holes 115 is equal to the number of posts 230 and further, the locations of the posts 230 and the locations of the holes 115 are selected so as to be in registration with one another when the grommet base 200 mates with one of the grommet backings 120, 130. As described herein, the posts 230 and holes 115 are constructed to form and establish a mechanical fit between the two parts and more specifically, after the posts 230 are inserted into the holes 115 and then a melt process can be used to attach the two parts as by forming an enlarged structure (e.g., mushroom cap) on the top of each post.

The first face (outer face) 212 is curved and in particular is a convex surface. This first face 212 is the part of the hanger ring 100 that is readily visible to the user and therefore the first face 212 is preferably a finished surface and/or has ornamental features. For example, the body 210 can be formed of plastic but the first face 212 can have a thin layer of metal that is deposited on the plastic using conventional techniques, such as electroplating. Alternatively, the entire body 210 can be plastic and the outer face 212 can be painted and/or otherwise decorated. As with the first part, the body 210 can likewise be formed of many different materials, including metals or plastics, etc.

Figure 1:
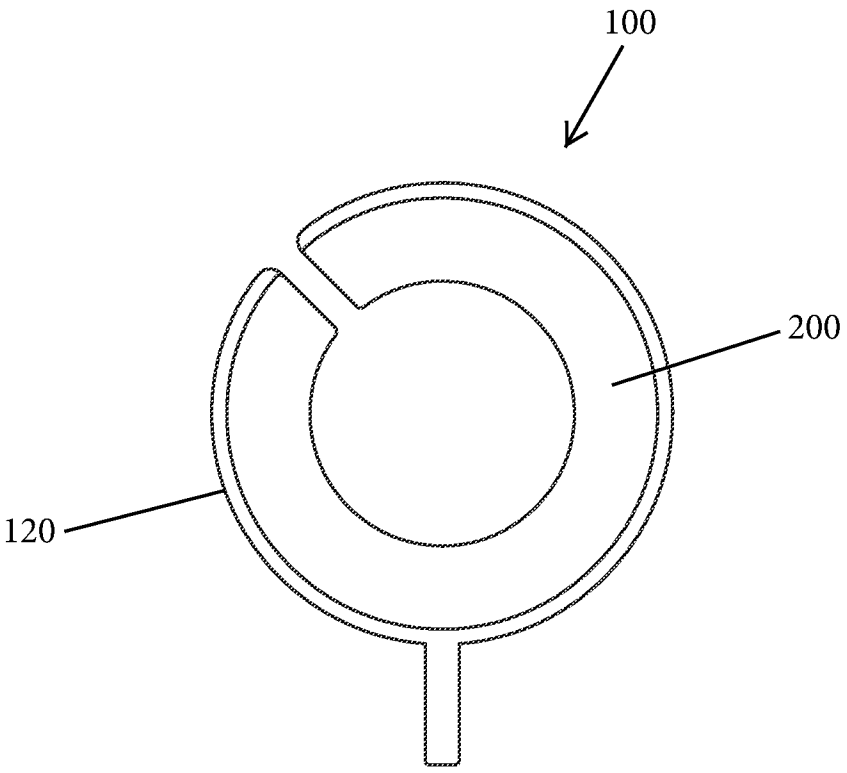
FIG. 1 is a front elevation view of a hanger hook assembly.
Figure 2:
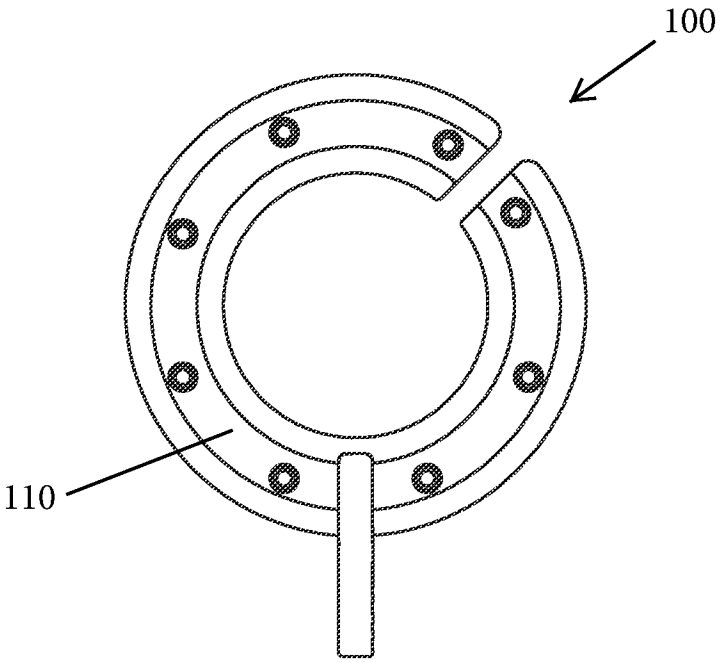
FIG. 2 is a rear elevation view of the hanger hook assembly.
Figure 3:
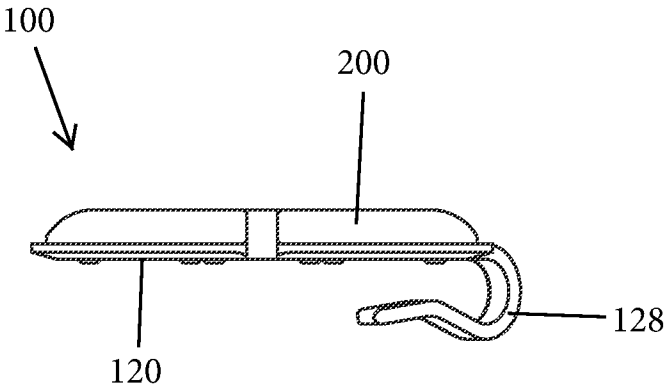
FIG. 3 is a side elevation view of the hanger hook assembly.
Figure 4:
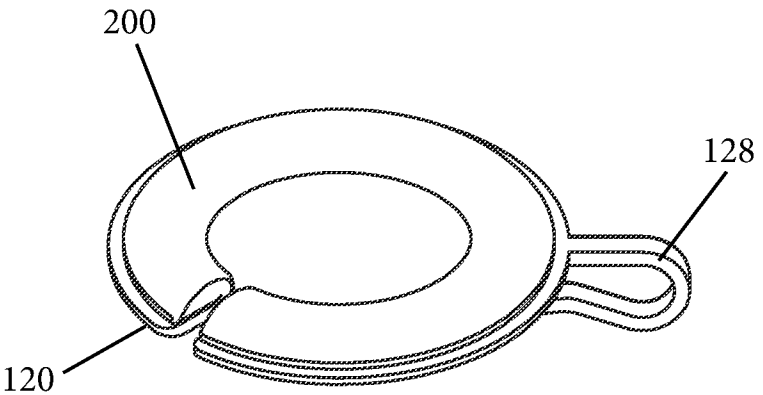
FIG. 4 is a perspective front view of the hanger hook assembly.
Figure 5:
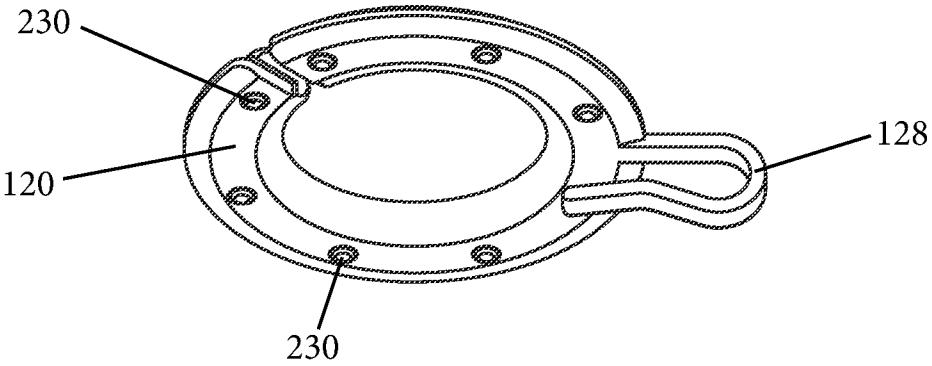
FIG. 5 is a perspective rear view of the hanger hook assembly.
Figure 8:
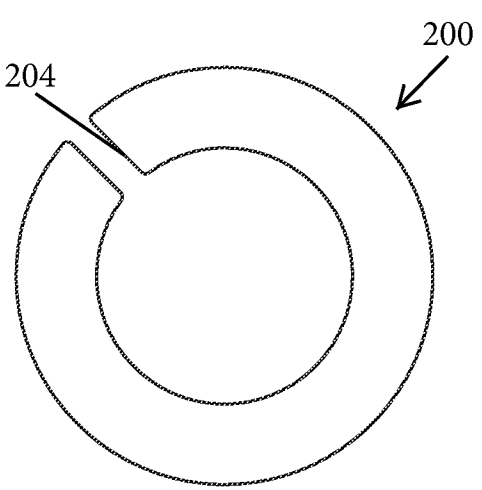
FIG. 8 is a front elevation view of a grommet base.

For illustration purposes only, FIGS. 1-5 show the mating of the parts 120 and 200 (it will be appreciated that the parts 130, 200 mate in a similar manner with just the overlapping slots being oriented between the 1 o'clock and 2 o'clock positions). FIG. 1 is a front view in which the grommet base 200 is the primary part which is seen, while FIG. 2, which is the rear view, shows the posts 230 protruding through the holes 115 to mechanically attach the two. As can be seen in FIGS. 3 and 5, when the two parts 120, 200 are mated together, the integral hook 128 is exposed and a gap is defined between the hook 128 and the body of the first part into which an article (e.g., a liner) can be captured.

Figure 19:
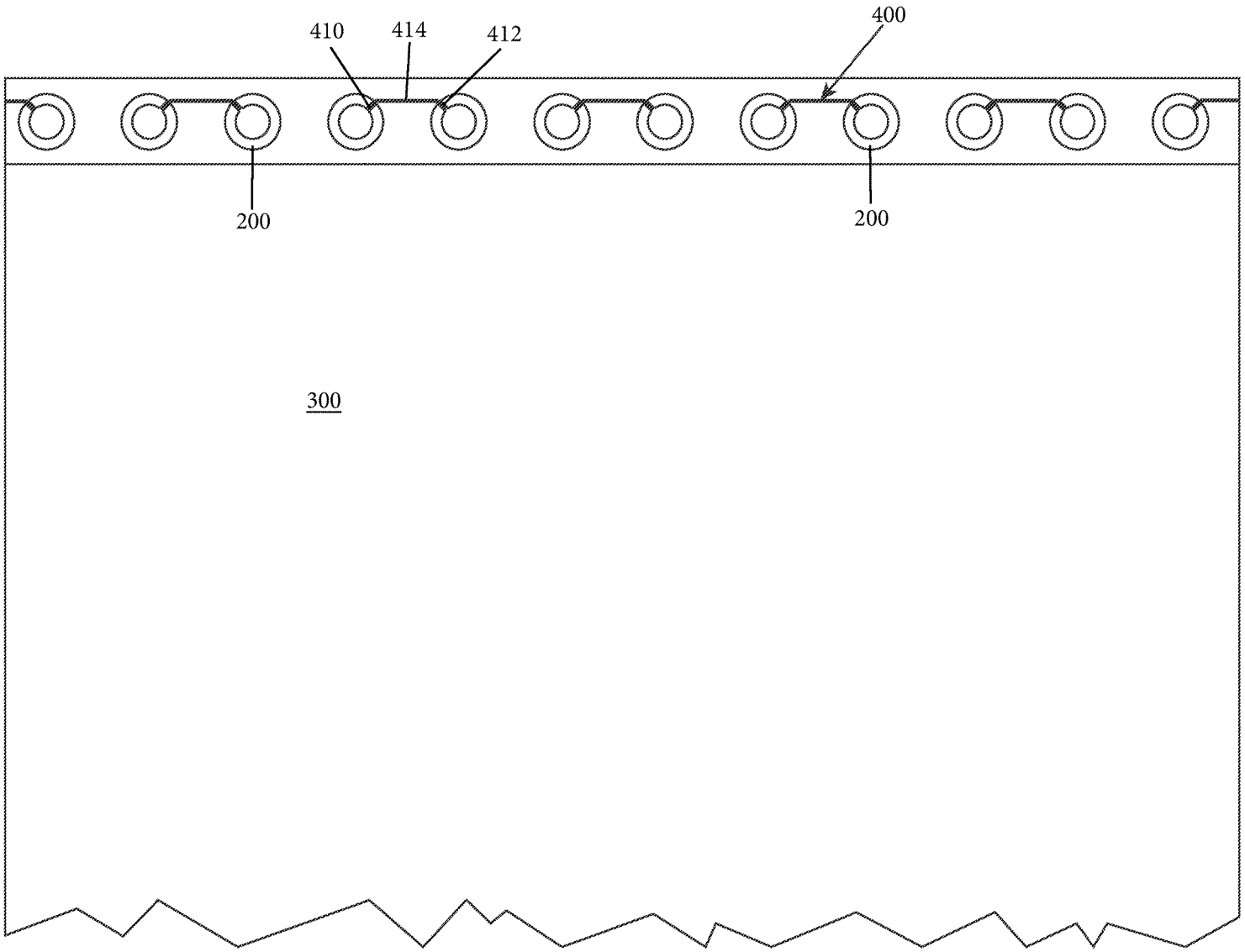
FIG. 19 is a front view of a plurality of hanger hook assemblies attached to a shower curtain.
Figure 20:
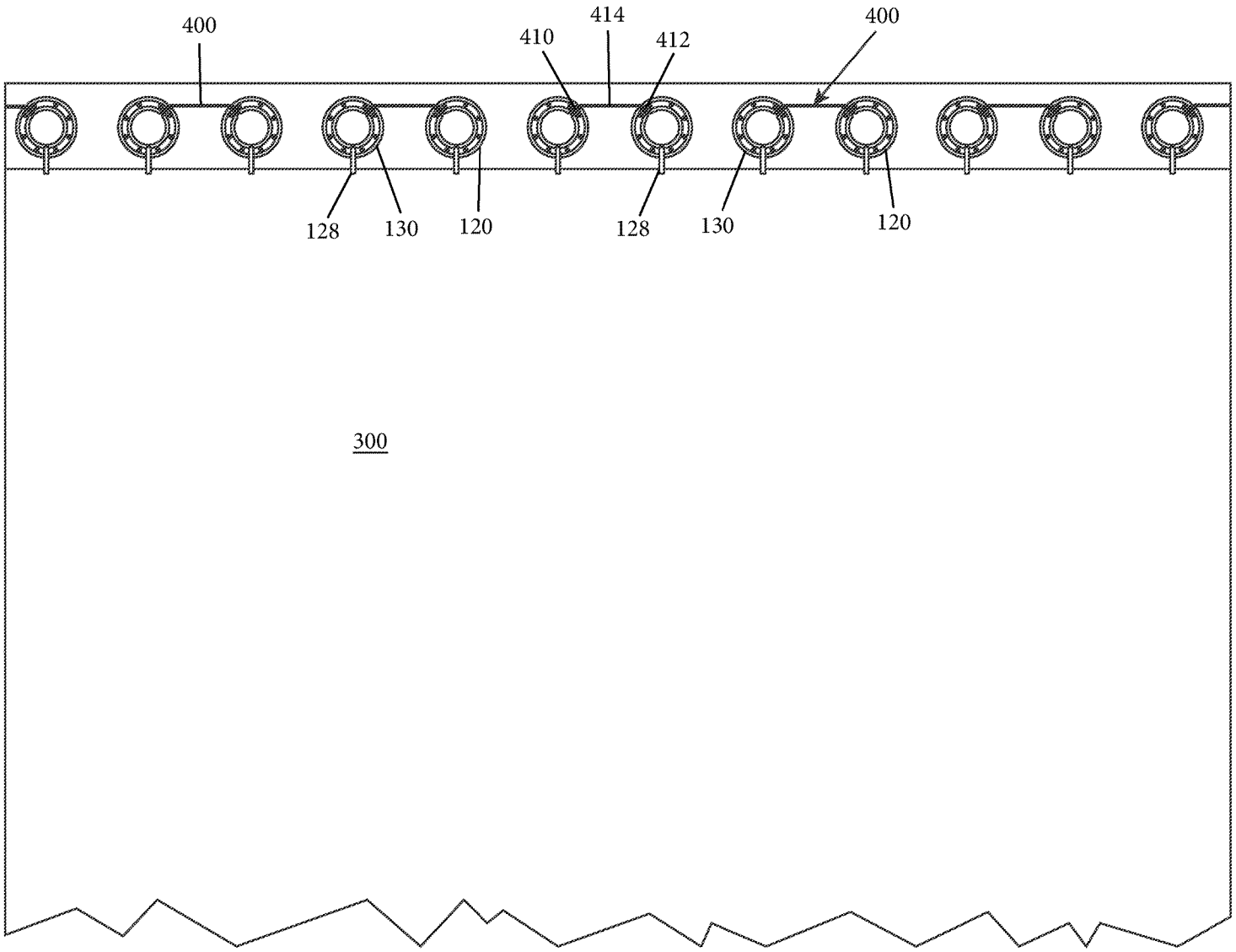
FIG. 20 is a rear view of the plurality of hanger hook assemblies attached to the shower curtain.
Figure 21:
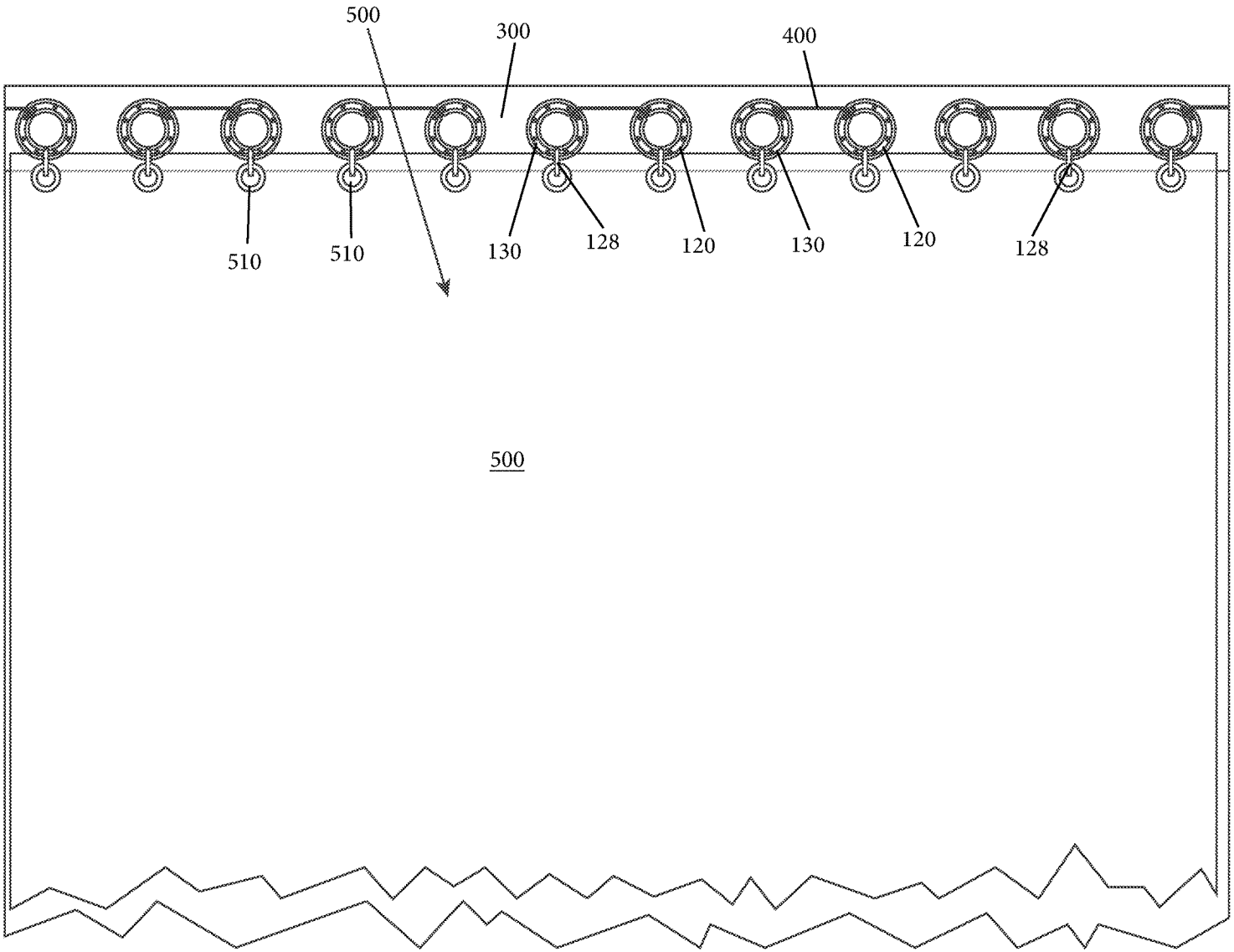
FIG. 21 is a rear view of the plurality of hanger hook assemblies attached to the shower curtain with a liner being suspended on the hanger hook assemblies.
Figure 23:
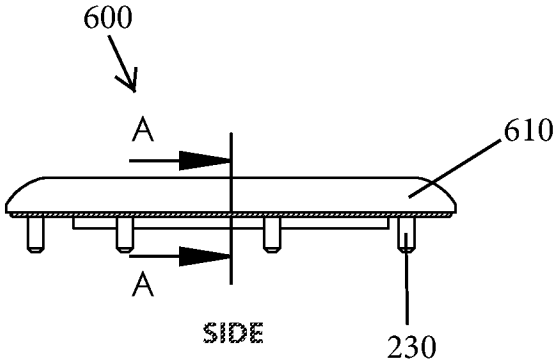
FIG. 23 is a side elevation view thereof.

FIGS. 19-21 show the hanger hook 100 in one intended application and more specifically, FIGS. 19-20 show the hanger hook 100 assembled (installed) onto a first hanging material 300 (e.g., shower curtain) that is supported by a pole or rod (not shown).

In one aspect of the present invention, the first hanging material 300 has sets of small openings (not shown) that receive the posts 230 to allow the part 200, which is disposed along a front side/face of the first hanging material 300, to engage the part 120, 130 which is disposed along a rear side/face of the first hanging material 300. The small openings are thus formed in a circumferential manner. These small openings can be formed using any number of conventional techniques, such as die punching.

The first hanging material 300 also has a plurality of discrete slits 400 formed therein. Unlike, the entirely linear slits formed in the prior art curtain, each discrete slit 400 is not entirely linear. Instead, the slit 400 has first and second angled end portions 410, 412 and a linear center portion 414. These angled end portions 410, 412 are aligned with the angled slots 123, 204 formed in the parts 120, 200. As discussed herein, these slots are complementary to the slots formed in the grommet backings 120, 130 and the grommet bases 200.

While the linear slit of the prior are was centrally located between two sets of small openings, the slit 400 formed between the two sets of small openings is disposed more upward toward a top edge of the first hanging material and more particularly, is located close to a topmost small opening.

The discrete slits 400 are formed in spaced arrangement across a width of the first hanging material 300 near a top edge of the first hanging material 300. As shown in FIG. 19, the angled end portions 410, 412 are angled downward. The slits 400 pass completely through the first hanging material 300. To assemble the hanger hooks 100 on the first hanging material 300, the grommet base 200 is positioned along the front face of the first hanging material 300 and one of the grommet backings 120, 130 is positioned on the rear face opposite the grommet base 200. The posts 230 of the grommet base 200 are inserted through the small openings formed in the first hanging material 300 and then the posts 230 are received into the respective openings 115 formed in one of the grommet backings 120, 130 to establish a mechanical connection between the parts 120, 130 and 200 with the first hanging material 300 captured between these parts.

As shown in FIG. 20-21, when the parts 120, 130 and 200 are mated together, the integral hooks 128 are all protruding downward and are in the 6 o'clock positions. The pole can be passed into the center opening of the hanger hook 100 by flexing the free ends of each of the parts 120, 130 and 200 to increase the space therebetween to a size that can receive the pole. The slits 400 also serve to receive the pole.

Unlike the slits in the prior art curtain which are visible when a person looks upward, the raised location of the slits 400 in the hanging material 300 is strategically selected so that the pole obscures the slits 400 from a viewpoint of outside of the tub. This results from moving the slits from a 3 o'clock position to a position that is generally at the 1 o'clock position or 10 o'clock position. This provides a much improved and cleaner appearance.

FIG. 21 shows a second hanging material (e.g., a liner) 500 being suspended by the integral hooks 128. The liner 500 includes a plurality of openings 510 (preferably reinforced openings) that are formed in a linear manner and proximate a top edge of the liner 500.

The integral hooks 128 are passed through the openings 510 resulting in the second hanging material 500 being suspended and hanging from the integral hooks 128. In this way, a liner 500 can be combined with a curtain 300 (shower curtain or window curtain). When the curtain 300 is a window curtain, the liner 500 can be in the form of a liner that is intended for use with a window curtain, such as a blackout liner or the like.

As with a traditional curtain/liner, the curtain/liner is moved along a length of the pole. The curvature 221 of the inner edge of the inner lip 220 is designed to reduce the catch point of the hanger hook 100 when the curtain/liner is moved (pulled) along a length of the pole. This curvature 221, unlike the straight edge of the prior art, is less prone to getting caught up with a right angle shoulder formed between two segments of the pole.

As described herein, the hanger hook 100 can be formed of any number of different suitable materials and can be formed in different sizes and different colors, etc.

FIGS. 22-28 depict another hanger hook according to an alternative embodiment. It will be appreciated in view of the figures that the hanger hook shown in FIGS. 22-28 is very similar to the one depicted in the previous figures and therefore, the following discussion will focus on differences between the two hanger hooks. In particular, the hanger hook is formed of a grommet base 600 that is similar to the grommet base 200.

The grommet base 600 is shown in FIGS. 22-25 and is defined by a body 610 that has an annular shape with a center opening 602 defined thereby. The center opening 602 has a circular shape when the body 610 is annular in shape as shown. The body 610 is of a split ring design in that there is a slot (opening) 604 formed therein so as to define first and second spaced free ends of the body 610. As described herein, since the body 610 is formed of a flexible material, the free ends can flex relative to one another thereby increasing the size of the gap/slot/space 604 to permit insertion of a support pole (rod) within the slot 604.

The illustrated body 610 has a first face (outer face) 612 and an opposing second face (inner face) 614, with the second face 614 for mating with an inner face of a complementary grommet backing as described below.

Unlike the previous grommet base 200, the grommet base 610 has a more hollowed body 610 in that the inner face 614 has been hollowed in sections to define both circumferentially spaced raised sections 615 and circumferentially spaced recessed sections 617.

Each raised section 615 includes one post 230.

Figure 25:
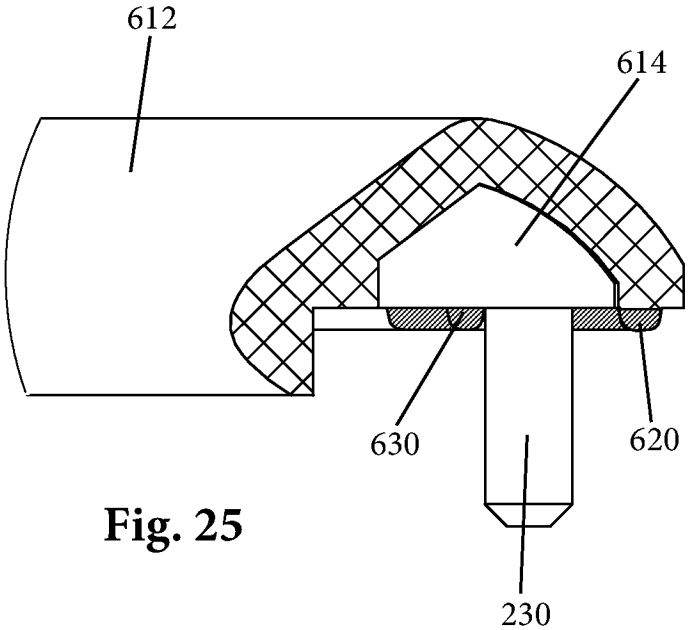
FIG. 25 is an enlarged local view taken along circle A of FIG. 24.
Figure 22:
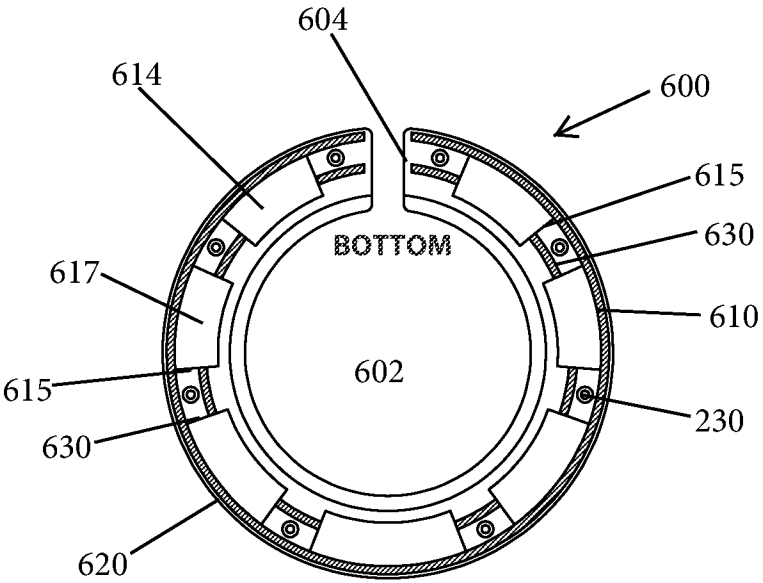
FIG. 22 is a bottom plan view of a grommet base according to another embodiment.
Figure 24:
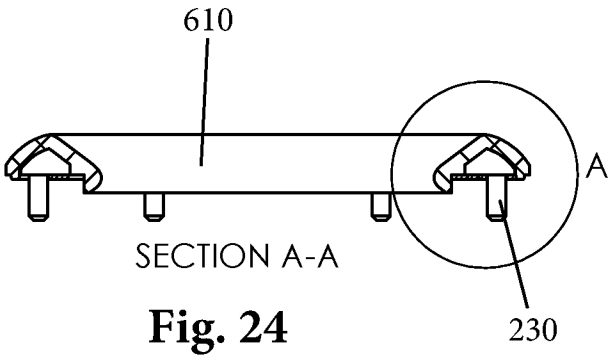
FIG. 24 is a cross-sectional view taken along the line A-A of FIG. 23.

Unlike grommet base 200, the grommet base 600 includes one or more protrusions that protrude upwardly from the inner face 614. As shown in FIGS. 22 and 25, the one or more protrusions can be in the form of a first protrusion 620 and a second protrusion 630 that is radially inward from the first protrusion 620. The first protrusion 620 can be in the form of an annular shaped protrusion (a raised ring or rim) and the second protrusion 630 can be in the form of a plurality of discrete circumferentially spaced protrusions. As shown, each second protrusion 630 can be in the form of an accurate shaped raised rail or lip or tooth that protrudes from one raised section 615. The post 230 is located between one second protrusion 630 and a portion of the first protrusion 620. As shown in FIG. 25, the post 230 is longer than both the first and second protrusions 620, 630 (it extends further away from the body).

Each of the grommet backings of this alternative hanger hook is designed to mate with the grommet base 600 similar to the previous embodiment in that the posts 230 extend through complementary holes 115 and then a process, such as melting the ends of the posts 230 is employed to join the grommet base and grommet backing. Like the previous embodiment, the grommet base 600) is configured to mate with both a first (left) grommet backing 700 (shown in FIGS. 26-28) and a second (right) grommet backing (not shown). It will be understood that, as previously discussed, the only difference between the left and right grommet backings is the location of the slot.

Figure 27:
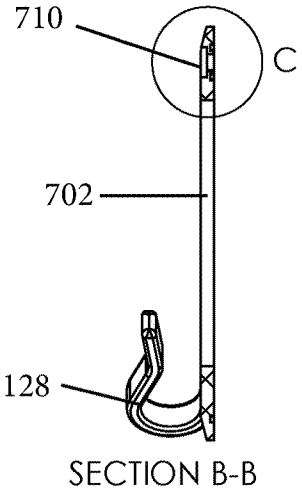
FIG. 27 is a cross-sectional view taken along the line B-B of FIG. 26.
Figure 28:
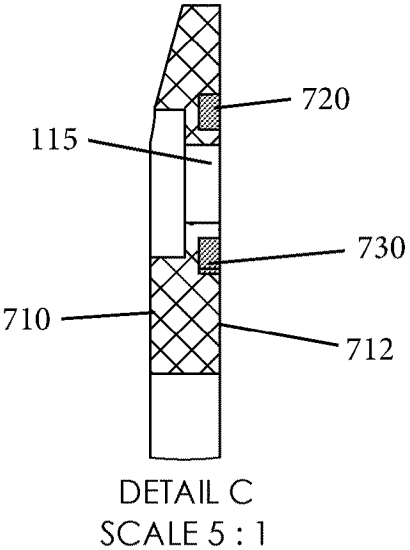
FIG. 28 is an enlarged local view taken along circle C of FIG. 27.
Figure 26:
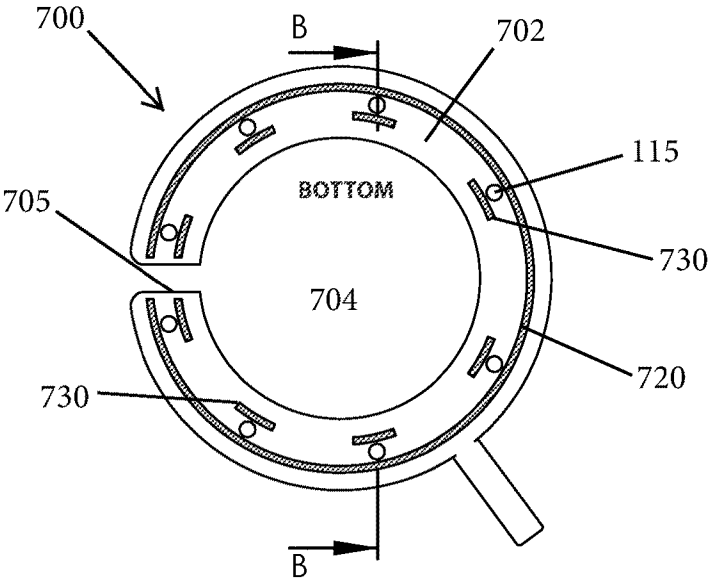
FIG. 26 is bottom plan view of one (left) grommet backing for mating with the grommet base of FIGS. 22-25.

The left grommet back 700 of FIGS. 26-28 is defined by a body 702 that has an annular shape with a center opening 704 defined thereby. The center opening 704 has a circular shape when the body 702 is annular in shape as shown. The body 702 is of a split ring design in that there is a slot (opening) 705 formed therein so as to define first and second spaced free ends of the body 702. As described herein, since the body 702 is formed of a flexible material, the free ends can flex relative to one another, thereby increasing the size of the gap/slot/space 705 to permit insertion of a support pole (rod) into the opening 704 and the pole also travels within the slot 705 when the pole is coupled to the rings.

The illustrated body 702 is a generally planar structure in that both a first face (outer face) 710 and opposing second face (inner face) 712 are generally smooth, flat surfaces that are parallel to one another. As shown in FIG. 28, the outer peripheral edge of the first face 710 can be slightly angled or curved (rounded).

The body 702 includes a plurality of through holes (openings) 115 that are formed therein spaced apart in a circumferential manner. The number of openings 115 can vary and as described herein, the openings 115 receive posts 230 of the grommet base 600 to attach and couple the grommet backing and grommet base to one another.

The body 702 also includes the integral hook (clip) 128 which is the same as the one previously described with reference to parts 120, 130.

In one embodiment, the first grommet backing 700 is formed as a single piece (e.g., a molded piece) that is formed of a suitable material, such as a plastic. However, it will be understood that the first grommet backing 130 can be formed of other suitable material, such as a metal, etc.

When the integral hook 128 is positioned in the 6 o'clock position with an outer face 710 of the backing 700 facing outward, the slot 705 is generally positioned between the 10 o'clock and 11 o'clock positions and is thus the left grommet backing.

The main difference with grommet backing 700 and the others is that the grommet backing 700 has a structure that complements the raised protrusions 620, 630 of the grommet base 600 to allow secure holding the article that is captured between the grommet backing and grommet base. The complementary structures, as shown, can be of a male/female type and more particularly, of a tongue and groove relationship.

In particular, as shown in FIGS. 26 and 28, along the inner surface 712, a first groove 720 is formed and spaced radially inward therefrom, there is a second groove 730. The first groove 720 can have an annular shape and thus can represent an annular shaped track (recess) that is configured to receive the annular shaped protrusion 620 (with the article captured therebetween). The second groove 730 can be in the form of a plurality of discrete, circumferentially spaced arcuate shaped grooves with one hole 115 being located between one second groove 730 and a portion of the annular shaped first groove 720. The second grooves 730 are formed at locations that complement the second protrusions 630 so that when the grommet backing 700 and grommet base 600 mate, the two structures are aligned and capture the article (e.g., shower curtain) therebetween.

It will be appreciated that the number, shape and/or size of the protrusions 620, 630 and/or grooves 720, 730 can vary. Also, the location of these male/females features can be reversed in that the grooves could be designed into the inner face of the grommet base and the teeth (protrusions) could be designed into the inner face of the grommet backing.

Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A hanger ring assembly for attachment to an article to be hung, the hanger ring assembly comprising:

a plurality of grommet backings including a set of first grommet backings and a set of second grommet backings, each first grommet backing being a split ring defined by a circular body with a first slot formed therein, the circular body having a plurality of spaced holes formed therein, each second grommet backing being a split ring defined by a circular body with a second slot formed therein, the circular body of the second grommet backing having a plurality of spaced holes, each of the first grommet backing and the second grommet backing including a clip extending outwardly therefrom, wherein a sagittal axis that passes longitudinally through the clip divides each of the first grommet backing and the second grommet backing into a first half and a second half, wherein the first slot is located in the first half, while the second slot is located in the second half, the first slot being formed at an angle other than 90 degrees relative to the sagittal axis and the second slot being formed at an angle other than 90 degrees relative to the sagittal axis; and a plurality of grommet bases that are configured to mate with both the first set of grommet backings and the second set of grommet backings, with the article disposed and captured therebetween, each grommet base being a split ring defined by a circular body with a slot formed therein;

wherein the clip is integrally joined to a bottom edge of the respective first grommet backing and second grommet backing and extends downwardly beyond and below the circular body of the respective first grommet backing and the second grommet backing such that the clip defines a bottommost point of each of the respective first grommet backing and the second grommet backing, the clip including a hook portion that lies beyond and below the circular body of the respective first grommet backing and the second grommet backing and curves upwardly toward a center of the respective first grommet backing and the second grommet backing such that a curved portion of the hook portion is spaced below the bottom edge of the respective first grommet backing and the second grommet backing;

wherein the hook portion terminates in a free end that is positioned orthogonally to a plane formed by a first face of the respective first grommet backing and the second grommet backing.

2. The assembly of claim 1, wherein when the clip of the first grommet backing is positioned at a 6 o'clock position, the first slot is located between about a 1 o'clock position and about a 2 o'clock position, while when the clip of the second grommet backing is positioned at a 6 o'clock position, the second slot is located between about a 10 o'clock position and about an 11 o'clock position.

3. The assembly of claim 1, wherein the first grommet backing comprises a right grommet backing and the second grommet backing comprises a left grommet backing.

4. The assembly of claim 1, wherein the first grommet backing, the second grommet backing, and the grommet base are formed of a flexible plastic material.

5. The assembly of claim 1, wherein the grommet base includes an inner peripheral edge that defines a center hole and an outer peripheral edge, the inner peripheral edge being defined by a first radius of curvature and the outer peripheral edge being defined by a second radius of curvature that is less than the first radius of curvature.

6. The assembly of claim 5, wherein a thickness of an inner peripheral portion that terminates at the inner peripheral edge is greater than a thickness of an outer peripheral portion that terminates at the outer peripheral edge.

7. The assembly of claim 6, wherein the circular body of each grommet base has a plurality of spaced protrusions that are configured for reception with the plurality of spaced holes of the respective first grommet backing and the second grommet backing and wherein an interface between the inner peripheral portion and the outer peripheral portion is defined by a right shoulder, the plurality of protrusions being formed adjacent the right shoulder.

8. The assembly of claim 1, wherein the plurality of grommet backings define a plurality of complementary pairs for attachment to the article in pairs, with one pair being defined by one first grommet backing and one second grommet backing, the first slot being defined by a first longitudinal axis and the second slot being defined by a second longitudinal axis, the first and second longitudinal axes intersecting one another since the first longitudinal axis and the second longitudinal axis are non-parallel.

9. The assembly of claim 1, wherein the plurality of grommet backings define a plurality of complementary pairs for attachment to the article in pairs, with one pair being defined by one first grommet backing and one second grommet backing, the first slot being defined by a first longitudinal axis and the second slot being defined by a second longitudinal axis, wherein the first and second longitudinal axis are not parallel to an axis extending along a top edge of the article.

10. The assembly of claim 1, wherein the circular body of each grommet base has a plurality of spaced protrusions that are configured for reception with the plurality of spaced holes of the respective first grommet backing and the second grommet backing.

11. The assembly of claim 1, wherein an inner face of each of the first grommet backing and the second grommet backing includes at least a first groove and an inner face of each grommet base includes a first protrusion that is complementary to and can be received within the first groove for capturing the article therebetween.

12. The assembly of claim 11, wherein the first groove comprises an annular shaped groove at a peripheral edge of the respective first or second grommet backing and the first protrusion comprises an annular shaped protrusion at a peripheral edge of the grommet base.

13. The assembly of claim 12, wherein the inner face of each of the first grommet backing and the second grommet backing includes one or more second grooves and an inner face of each grommet base includes one or more second protrusions that are complementary to and can be received within the one or more second grooves for capturing the article therebetween, the one or more second grooves being radially inward from the first groove and the one or more second protrusions being radially inward from the first protrusion.

14. The assembly of claim 1, wherein the clip is formed at a bottom of each of the first grommet backing and the second grommet backing.

15. The assembly of claim 1, wherein the clip is integrally formed with each of the respective first grommet backing and the second grommet backing so as to form a single part.

16. The assembly of claim 1, wherein the slot formed in the grommet base: (1) aligns with the first slot when the grommet base is mated to the first grommet backing and (2) aligns with the second slot when the grommet base is mated to the second grommet base.

17. A hanger ring assembly for attachment to an article to be hung, the hanger ring assembly comprising:

a plurality of grommet backings including a set of first grommet backings and a set of second grommet backings, each first grommet backing being a split ring defined by a circular body with a first slot formed therein, the circular body having a plurality of spaced holes formed therein, each second grommet backing being a split ring defined by a circular body with a second slot formed therein, each of the first grommet backing and the second grommet backing including a clip extending outwardly therefrom, wherein a sagittal axis that passes longitudinally through the clip divides each of the first grommet backing and the second grommet backing into a first half and a second half, wherein the first slot is located in the first half, while the second slot is located in the second half, the first slot being formed at an angle other than 90 degrees relative to the sagittal axis and the second slot being formed at an angle other than 90 degrees relative to the sagittal axis; and a plurality of grommet bases that are configured to mate with both the first set of grommet backings and the second set of grommet backings, with the article disposed and captured therebetween, each grommet base being a split ring defined by a circular body with a slot formed therein;

wherein the clip is formed at and extends beyond a bottom curved edge of one of the first grommet backing and the second grommet backing, respectively; and the clip includes a hook portion that curves upwardly toward a center of the respective first grommet backing and the second grommet backing and terminates in a free end, wherein a curved portion of the hook portion is located radially outward from the bottom curved edge and the hook portion is defined by a first wall and a second wall with a space formed between the first and second walls for receiving the article to be hung, wherein each of the first wall and second wall of the hook portion is spaced below the bottom curved edge, the free end of the hook portion being located along a first face of the respective first grommet backing and the second grommet backing that is opposite a second face along which the respective grommet base is disposed;

wherein the free end is positioned orthogonally to a plane formed by a first face of the respective first grommet backing and the second grommet backing.

18. The assembly of claim 17, wherein the first wall of the hook portion lies in a same plane as the circular body of the respective first grommet backing and the second grommet backing and the second wall has a bend formed therein.

19. The assembly of claim 17, wherein the second wall of the hook portion has a bend formed therein which defines a first point at which a distance between the first wall and the second wall are at a minimum, the first point being located along the second wall between the free end of the clip located at an end of the second wall and the curved portion.

* * * * *